US006962162B2

(12) United States Patent
Acker

(10) Patent No.: US 6,962,162 B2
(45) Date of Patent: Nov. 8, 2005

(54) METHOD FOR OPERATING A MULTI FAMILY/COMMERCIAL PLUMBING SYSTEM

(75) Inventor: Larry K. Acker, Costa Mesa, CA (US)

(73) Assignee: Act, Inc., Costa Mesa, CA (US)

( * ) Notice: Subject to any disclaimer, the term of this patent is extended or adjusted under 35 U.S.C. 154(b) by 0 days.

(21) Appl. No.: 10/936,173

(22) Filed: Sep. 8, 2004

(65) Prior Publication Data

US 2005/0022871 A1 Feb. 3, 2005

Related U.S. Application Data

(63) Continuation-in-part of application No. 10/894,141, filed on Jul. 19, 2004, which is a continuation-in-part of application No. 10/010,691, filed on Nov. 9, 2001, now abandoned.

(51) Int. Cl.[7] ..... F16K 49/00

(52) U.S. Cl. ..... 137/1; 137/337; 137/357; 137/565.01; 137/565.16; 137/624.12; 126/362; 417/12; 417/32

(58) Field of Search ..... 417/12, 32; 137/337, 137/565.01, 565.16, 357, 624.12, 1; 126/362

(56) References Cited

U.S. PATENT DOCUMENTS

| | | | | |
|---|---|---|---|---|
| 4,756,030 A | * | 7/1988 | Juliver | 4/668 |
| 4,870,986 A | * | 10/1989 | Barrett et al. | 137/119.1 |
| 5,351,712 A | * | 10/1994 | Houlihan | 137/337 |
| 5,775,372 A | * | 7/1998 | Houlihan | 137/624.12 |

* cited by examiner

*Primary Examiner*—A. Michael Chambers
(74) *Attorney, Agent, or Firm*—Walter A. Hackler

(57) ABSTRACT

A method for operating a multi-family/commercial plumbing system includes sensing an event and recording for each sensed event at least one parameter selected from the group consisting of date, day of the week, start time, duration of the event, water flow, water temperature, and humidity. The parameters are analyzed to determine a pattern and thereafter water flow, circulation, water temperature, and water use are controlled in accordance with the determined pattern.

8 Claims, 4 Drawing Sheets

METHOD FOR OPERATING A MULTI FAMILY/COMMERCIAL PLUMBING SYSTEM

This application is a CIP of Ser. No. 10/894,141 filed Jul. 19, 2004 which is a CIP of Ser. No. 10/010/,691 filed Nov. 9, 2001, abandoned.

The present invention is generally directed to plumbing systems and more particularly to operation of plumbing systems to attain high thermal and economic efficiency.

Water and energy conservation is of utmost importance. This is true for both home and commercial plumbing systems. In the home, a considerable amount of thermal energy may be wastefully dissipated from hot water lines which provide hot water to plumbing fixtures, such as domestic wash basins, showers, dishwashers, washing machines, etc. Commercial establishments also experience wasteful water and energy losses due to continuously running recirculation systems or for timing or delivering hot water to numerous fixtures, such as in hotels and the like. In both home and commercial establishments, if water is allowed down the drain while waiting for hot water to be delivered to the fixture from a remote hot water source, a substantial water loss may occur.

In some homes and many commercial establishments, such water loss is reduced by providing plumbing systems which continuously circulate hot water from a hot water source to the fixture and back to the hot water source. In this arrangement, a supply of hot water is always adjacent to a plumbing fixture despite the remote position of the hot water source.

While this arrangement reduces water loss, it is not energy efficient because the array of pipes interconnecting the plumbing fixtures and the hot water source provide an enormous surface area for thermal radiation. In addition, the electrical expense of running a circulation pump may be prohibitive in view of the latest energy costs.

Thermal losses in both circulating and non-circulating plumbing systems have been reduced by insulation of the hot water lines a well as the hot water heaters which feed the plumbing fixtures. While such insulation slows the dissipation of heat, no savings occur over an extended period of time in non-circulating systems because intermittent use of hot water through the lines still allows hot water to cool to ambient temperatures. That is, the insulation merely delays the heat dissipation but does not reduce is.

Hot water demand systems have been developed, such as for example, set forth in U.S. Pat. Nos. 5,277,119, 5,385,161 and 5,829,475. The system described in these patents significantly reduces water and energy loss through the use of a demand control. That is, whether a recirculation conduit is utilized or a cold water line is utilized for circulation of water, such circulation is initiated only upon demand by a user. Such demand may be a manual switch, temperature sensor or the like.

The present invention provides for a demand for hot water recovery, or recirculation system which utilizes a controller to provide a method to activate recirculation of hot water based upon analyses of actual use of hot water.

SUMMARY OF THE INVENTION

A method of operating a plumbing system having a circulating pump in accordance with the present invention generally includes sensing activation of the pump and thereafter recording for each sensed activation at least one parameter selected from a group consisting of date, day of the week, start time, duration of pump activation, hot water flow, and temperature and cold water flow in temperature.

Thereafter analyzing the recorded parameters to determine patterns of pump activity and activating the pump in accordance with the term and patterns.

Preferably, the method according to the present invention includes reiterating the hereinabove noted steps for providing updated patterns of pump activity, thus enabling pump activation to be continually changed in response to usage of the system.

More particularly, the present invention may also include analyzing the determined patterns for potential problems, such potential problems including, but not limited to identifying a leak in the plumbing system, excess running of the pump, and non-seasonal changes in a relationship between hot and cold water use. Also, temperature sensors may be used to detect freezing temperature and circulating water to avoid damage.

Thus, the present invention provides a method for managing water usage and reducing water waste and energy waste which is dependent upon actual use of the plumbing system.

In addition, the present invention encompasses a hot water recirculation system which includes a hot water source, at least one plumbing fixture having a hot water inlet, a conduit in fluid communication with the hot water source and the plumbing fixture hot water inlet for enabling circulation of hot water from the hot water source to the plumbing fixture and returned to the hot water source, a pump for circulating hot water through the conduit and a controller for sensing activation of the pump, recording for each sensed activation at least parameter selected from the group consisting of date, day of the week, start time, duration of pump activation, hot water flow, and temperature and cold water flow in temperature. Controller is further functional for analyzing the recorded parameters to determine a pattern of pump activation and activating the pump in accordance with the determined pattern.

In another embodiment of the present invention, a method for operating a multi-family/commercial plumbing system generally includes sensing events with each event comprising at least one of a group consisting of measurement of water temperature and water flow between a storage tank water, and a boiler, measurement of water flow in and out of the boiler, detection of water leaks in hot and cold water lines, measurement of water temperature in hot water flow from a hot water heater, measurement of moisture in walls and floors, detection of activation of dampers, measurement of room temperature in each of a plurality of rooms, and detection of operation of a water circulation pump.

The method further comprises recording for each of the sensed events at least one parameter selected from a group consisting of a date, day of the week, start time, duration of the event, water flow, water temperature and humidity. Thereafter, in accordance with the present invention, the record parameters are analyzed to determine patterns and water flow, circulation, water temperature and efficient water use is effected with conservation of energy.

BRIEF DESCRIPTION OF THE DRAWINGS

The advantages and features of the present invention will appear from the following description when considered in conjunction with accompanying drawings in which.

DETAILED DESCRIPTION

Figure 1:
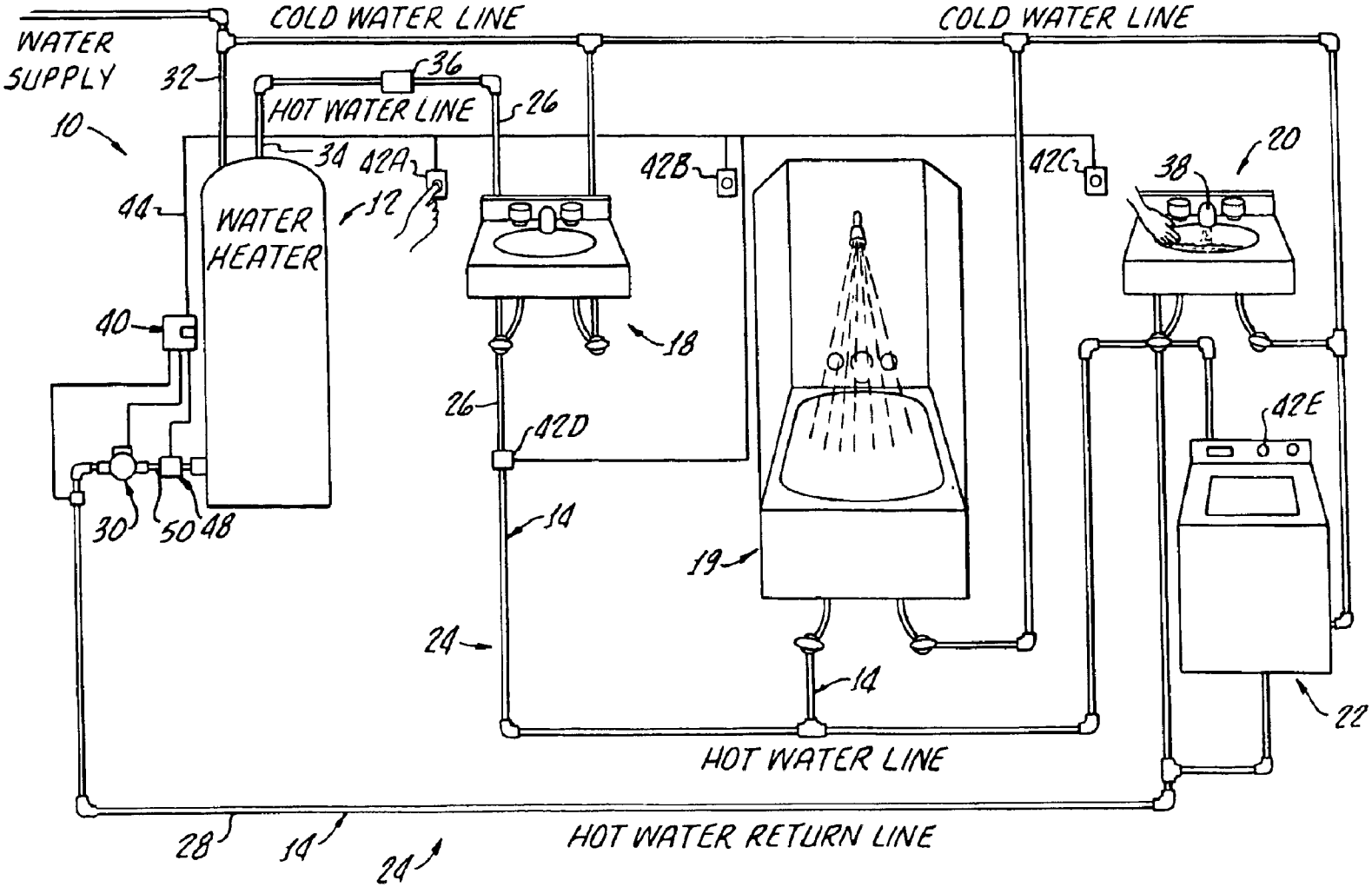
FIG. 1 is a flow diagram of a demand hot water recirculation system in accordance with the present invention generally showing hot water source and a conduit in communication with at least one plumbing fixture along with a pump, switches and a controller for activating the pump based upon a statical analysis of control signal timing.

With reference to FIG. 1, a hot water recirculation system 10 is shown in accordance with the present invention. The system 10 generally comprises a hot water source, for example a water heater 12, such as for example, a gas, oil, solar or electric tanks or tankless heater, interconnected by means of pipes 14 with plumbing fixtures 18, 19, 20, 22, said pipes providing conduit means for enabling circulation of hot water from said hot water source 12 to each plumbing fixture 18, 19, 20 and return to the hot water source 12. The pipes 14 are thus in fluid communication with the hot water source 12 and the plumbing fixtures 18, 19, 20 in such a way as to establish a hot water loop 24.

More particularly, the pipes 14 may be comprised of a hot water supply line 26 which provides means for transferring hot water from the water heater 12 to each of the fixtures 18, 19, 20, 22 and a separate hot water return line 28 which provides means for enabling recovery of hot water in the pipes 14 and into the water heater 12, after usage of any one of the fixtures 18, 19, 20.

The hot water source 12 may be connected to a cold water source through inlet pipe 32. The hot water source 12 may be heated in any conventional manner. It should be appreciated that the hot water source 12 may be a conventional gas, electric, solar tank or tankless water heater, heater coils or other apparatus as described in U.S. Pat. No. 4,798,224, entitled "Automatic Hot Water Recovery System" or the apparatus described in U.S. Pat. No. 5,042,524, entitled "Demand Recovery System". These patents are incorporated herein by specific reference thereto for the purpose of identifying and describing such hot water recovery apparatus.

A pump 30 may be installed in the hot water loop 24 or as part of a water heater for providing means for circulating hot water through the loop 24.

In addition, a switch 36 provides means for generating a control signal and activating the pump 30. More particularly, the switch 36 may comprise a flow switch which detects water flow through the pipes 14, for example, when a user opens a hot water valve, such as a faucet 38, on one of the plumbing fixtures 18, 19, 20, 22. The control signal is provided to a controller 40 by wire or wireless means. In this manner, the activating of the pump 30 is sensed.

Alternatively, a manual switch 42A, a proximity switch 42B, a motion detector 42C, a temperature sensor 42D, an appliance switch 42E or a sound or voice activated switch may be utilized to generate control signals indicating use of a fixture 18, 19, 20, 22. The appliance switch 42E may be a microchip which is programmed to send a signal when the appliance 22 is activated for use but before actual start of an appliance cycle.

The switch 36 may be a flow switch of conventional construction which generates a signal, for example an electrical signal, in response to water flow through the pipe 14. Although the flow switch is shown disposed adjacent the hot water source 12, it may alternatively be disposed beneath any one of the fixture 18, 19, 20, 22. Alternative to, or in addition to, the flow switch 36, the control signal may be generated by means of a manually activated switch 42 interconnected with the controller 40.

The controller 40 which may include a processing microchip, is responsive to a plurality of control signals through an electrical line 44, or by wireless communication, for activating the pump 30, by providing electrical power thereto.

The microchip is preferably a programmable microprocessor and performs one or more statistical analysis of the activation of any of the switches 36, 42A–42E as a function of time to determine, for example, the average time of day a fixture 18, 19, 20, 22 used. The microprocessor collects data from the switches for a predetermined period of time, days or weeks, for example, and updates the analysis on a timely basis to determine turn on times. The pump 30 is then turned on, or activated, shortly before actual average use time. The interval of anticipation can be adjusted so that hot water is circulated to the future 18, 19, 20, 22 prior to use. As the time of use may change, for example a switch to daylight saving, the controller automatically adjusts pump 30 activation. Thus, no manual setting or resetting is required. If the fixtures are not used, the controller will adjust to a non-activating cycle of pump 30 activation. This is particularly useful in commercial establishments such as hotels certainly and the like, as well as for home use.

A valve 48 may be provided for preventing any flow of water through the hot water pipes 14. The zone valve 48 may be disposed, as shown in FIG. 1, directly between the hot water source 12 and the pump 30 or in the pump 30 or in the hot water source.

The valve 48 may be of a conventional type, such as, for example a zone valve which provides complete closure of the pipe 14 at a valve junction 50. The zone valve may be built into the pump 30 or water tank 48 and is preferably comprised of a suitable material and structure that will provide an insulating barrier between water on either side of the valve 48 when the valve 48 is in the closed to flow position, thus minimizing loss of heat from the hot water source 12 into water in the adjacent return line 28. When the zone valve 48 is in the closed position, the hot water source 12 is physically isolated from standing water in the return line 28. The zone valve 48 may, if desired, as noted above, be incorporated into the pump 30 or hot water source 12.

The zone valve 48 is normally closed to a flow of water therethrough. During periods of nonuse of a plumbing fixture 18, the zone valve 48 is in a closed position, thus providing a positive barrier between the hot water source 12 and water in the return line 28. This prevents any circulation which may be caused by temperature differences.

The controller 40 is interconnected with the switch 36 42A–42E and the zone valve 48 and provides means for causing the zone valve 48 to open and allow water flow therethrough in response to the control signal. Preferably both the pump 30 and the zone valve 48 may be electrically activated in response to the control signals as hereinabove described.

It should be appreciated that once the pump 30 has drawn a sufficient amount of hot water from the water heater 12 to reach all of the fixtures 18, 19, 20, 22, particularly the fixture most remote from the water heater 12, operation of the pump 30 may be stopped.

The controller 40 may be also electronically programmed to control a sequence of operation of the pump 30 and zone valve 48. For example, when the temperature sensor 62 has detected a temperature increase of between about 1° C. and about 15° C. the entire loop 24 may be filled with hot water, and a control signal may be sent to the controller and cause the pump 30 to stop. At this point, the zone valve means 48 will close shortly or immediately thereafter and the system 10 will resume a standby position. The controller function may be overridden, if desired, by appropriate manual switches (not shown).

Figure 2:
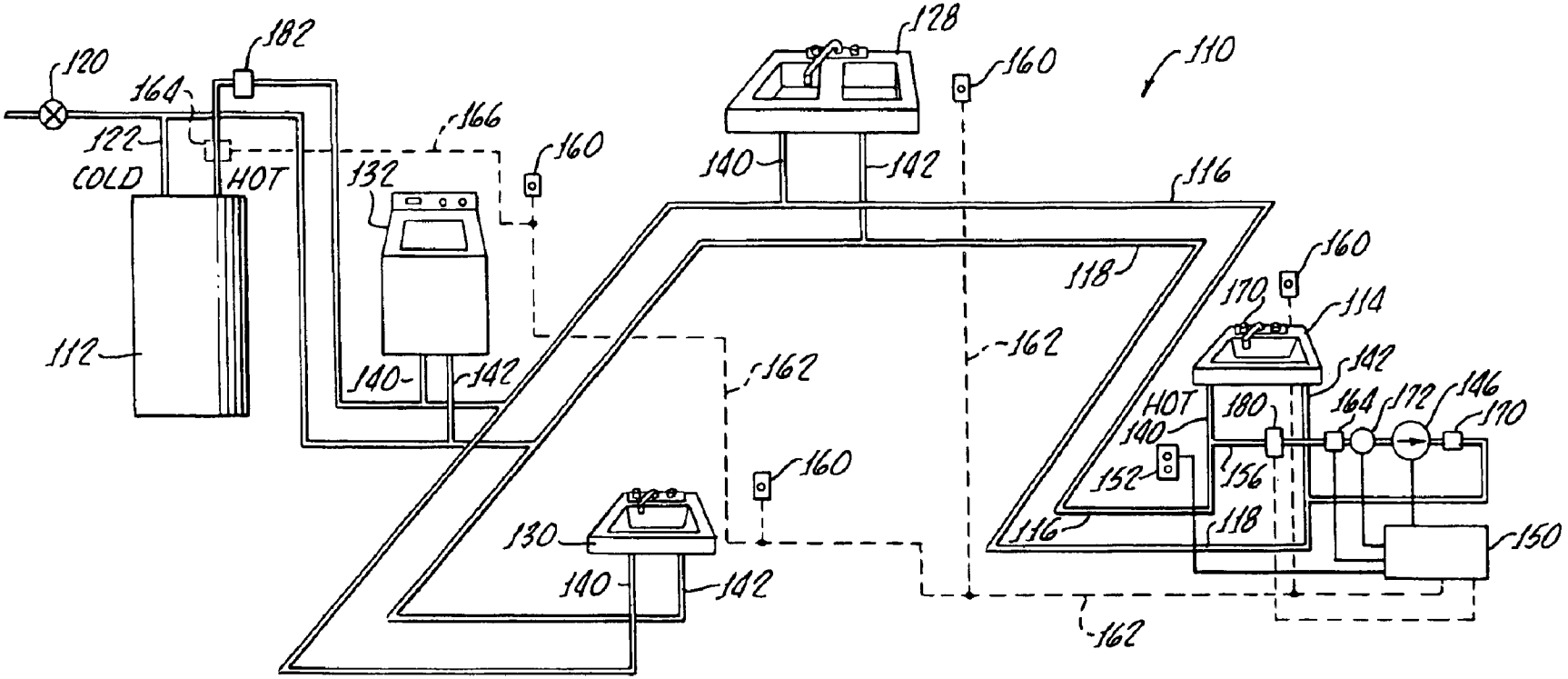
FIG. 2 is a flow diagram of an alternative embodiment of the present invention directed to a demand hot water recovery system utilizing a hot water source, a hot water delivery line connected between the hot water source and at least one plumbing fixture, a cold water delivery line between the plumbing fixture, cold water source and hot water source, a pump for circulation of water from the hot water delivery line through the cold water delivery line and into the hot water source, a switch for generating control signals and a controller responsive to a plurality of control signals for activating the pump based upon a statistical analysis of control signal timing.

With reference to FIG. 2, there is shown, as an alternative embodiment of the present invention, a hot water recovery system 110 which generally includes a hot water source 110 such as a gas or electric hot water heater, connected to a plumbing fixture such as a sink 114 by a hot water deliver line 116. It is to be appreciated that the hot water source 112 may be a heater 112 as shown or an apparatus as described in U.S. Pat. No. 4,798,224, entitled "Automatic Hot Water Recovery System," or that shown in U.S. Pat. No. 5,042,524, entitled "Demand Recovery System". Also provided in the conventional manner is a cold water delivery line 118 interconnecting the sink 14 with a cold water source 120 which is also interconnected with the hot water source 112 via a feed line 122.

Optional plumbing fixtures such as sinks 128, 130 and washing machine 132 may be provided along with many other common plumbing fixture utilized in residences and businesses, all such fixtures being connected in a parallel configuration with the hot water delivery line 116 and cold water delivery line 118 by feed lines 140 and 142, respectively. At a selected plumbing fixture, such as the sink 114 which is most remote from the hot water source 112, a pump 146 is interconnected between the hot water delivery line 116 and the cold water delivery line 118 via the feed lines 140, 142 respectively. The pump provides means for circulating water from the hot water delivery line 116 through the cold water delivery line 118 and back into the hot water source 112 via line 122, by utilizing the cold water delivery line as a return feeder to the hot water source 112. No separate circulation line need be implemented in new systems. In order for the pump 146 to effect flow in a reverse manner through the cold water delivery line 118 and into the hot water tank 112, the pump 146 must, of course, develop sufficient heat to overcome static water pressure in the line.

The hot water delivery system 110 of the present invention can be used in conjunction with an existing system, which may include the hot water source 112, hot and cold water delivery lines 116, 118, and a plumbing fixture 114. In this instance, the pump 146 and controller 150, to be described hereinafter in greater detail, may be installed approximately fixture 114 without disturbing the reminder of the existing plumbing system. The advantages of this embodiment is significant in that no unwanted disruption of the home or business is needed in order to implement the hot water recovery system in accordance with the present invention.

The control system, or controller, 150 is the same in function as hereinabove described controller 140 and provides a means for switching electrical current outlet 152 to the pump 146 in order to cause the pump 146 to circulate water from the hot water line 16 to the cold water line 118.

A temperature sensor 154 may be disposed in a line 156 interconnecting the pump 146 with the hot water delivery line 116 through the feeder 140, providing means for causing the control means to stop the pump 146 to prevent heated water from being circulated through the cold water delivery line 118 as will be hereinafter described. The temperature sensor 154 may be of conventional or of special design inserted into the line 156 for water flow thereover, or it may be a thermostat type of detector strapped to the outside of the line 156 or incorporated into the hot water source 12 or pump 30. The sensor 154 may be of a type for detecting a selected water temperature and in response thereto causing the control system to stop the pump 146.

However, it has been found that the sensitivity of such sensors may not be sufficient to prevent unwanted hot water from entering the cold water delivery line 118. Thus, a preferred embodiment of the present invention is a temperature sensor 154 which is configured for detecting a temperature increase, or gradient, such a one or two degrees and in response thereto, causing the control system 152 stop 146. Thus, no matter what the actual temperature of the water in the line 156 is, an increase of one or two degrees will cause the pump 146 to stop. The temperature sensor 154 may also be operative for detecting freezing temperature thus enabling the control system 152 to circulate water and avoid freeze damage.

Preferably, the pump 146 is activated by the controller 150 in a manner hereinabove described for controller 40 by statistically analyzing a plurality of control signals generated by switch 160. As hereinabove noted, the switch 160 may be manual, motion detection, proximity detection, temperature detection a flow detector 164, or by microphone sensitive to voice or other sounds, as herein described.

Although the flow detector 164 is shown adjacent to the hot water source 112, it may be alternatively disposed in the line 140 beneath the fixture 114 for reducing the electrical interconnection required and for enabling all of the apparatus of the present invention to be disposed beneath the fixture 114.

It should be appreciated that if the pump 146 is not a positive displacement type which does not allow water to flow in a reverse manner through it, then a one-way valve 170 should be provided to prevent such flow and preferably a solenoid 172, controlled by the control system 150, should be inserted upstream of the pump 146 to prevent water flow through the pump 146 when the control system 150 turns off pump 146.

It should also be appreciated that the temperature sensor 152 should be disposed in the hot water line or attached to it as hereinbefore described to prevent a rescission between the hot water delivery line 116 and the cold water delivery line 118. However, the pump can be located anywhere throughout the system 110 between the hot water delivery line 116 and cold water delivery line 118.

In another embodiment of the present invention, a microphone 180 may be attached to the hot water delivery line 116 which provides a sound sensing means for detecting water flow in the hot water delivery line 116 and generating a control signal corresponding thereto which is fed into the control system 150 in order to turn on the pump 146 as hereinabove described.

In addition, a sound-producing element 182 may be installed in the hot water delivery line 116, preferably proximate to hot water source 112, for generating a characteristic sound in response to water flow in the hot water delivery line 116.

Such an element may include any rotatable device such as a propeller, not shown, which produces a sound when rotated by water flowing therepast. However, any suitable sound-generating element 182 may be utilized in the present invention. Since the sound naturally travels through the delivery line 116 with water therein no separate wiring is necessary, and the microphone 80 is preferably configured in any conventional manner for being sensitive to the sound generated by the element 182. As hereinabove noted, a separate microphone, or sound sensitive device, 80 may be utilized for voice or sound activation for production of a control signal for inputting to the controller.

While the present invention has been described as a whole home or commercial plumbing installation, it should be appreciated that, the present invention may be used in zones of a larger plumbing system as hereinafter described. That is, rooms may be zoned if the plumbing is in a "Trunk and Branch" line system. In other words, if the plumbing (not shown) is set up where the pipes (hot water) were not in a loop but plumbed in direction associated with certain sections of the home and at the end of the hot water line a valve is placed that could pick up a signal when hot water was demanded or anticipated by the user. This way hot water would only flow to that zone or part of the home. The zones could be on dedicated loops or use the cold water return line as we do in hot to cold.

Figure 3:
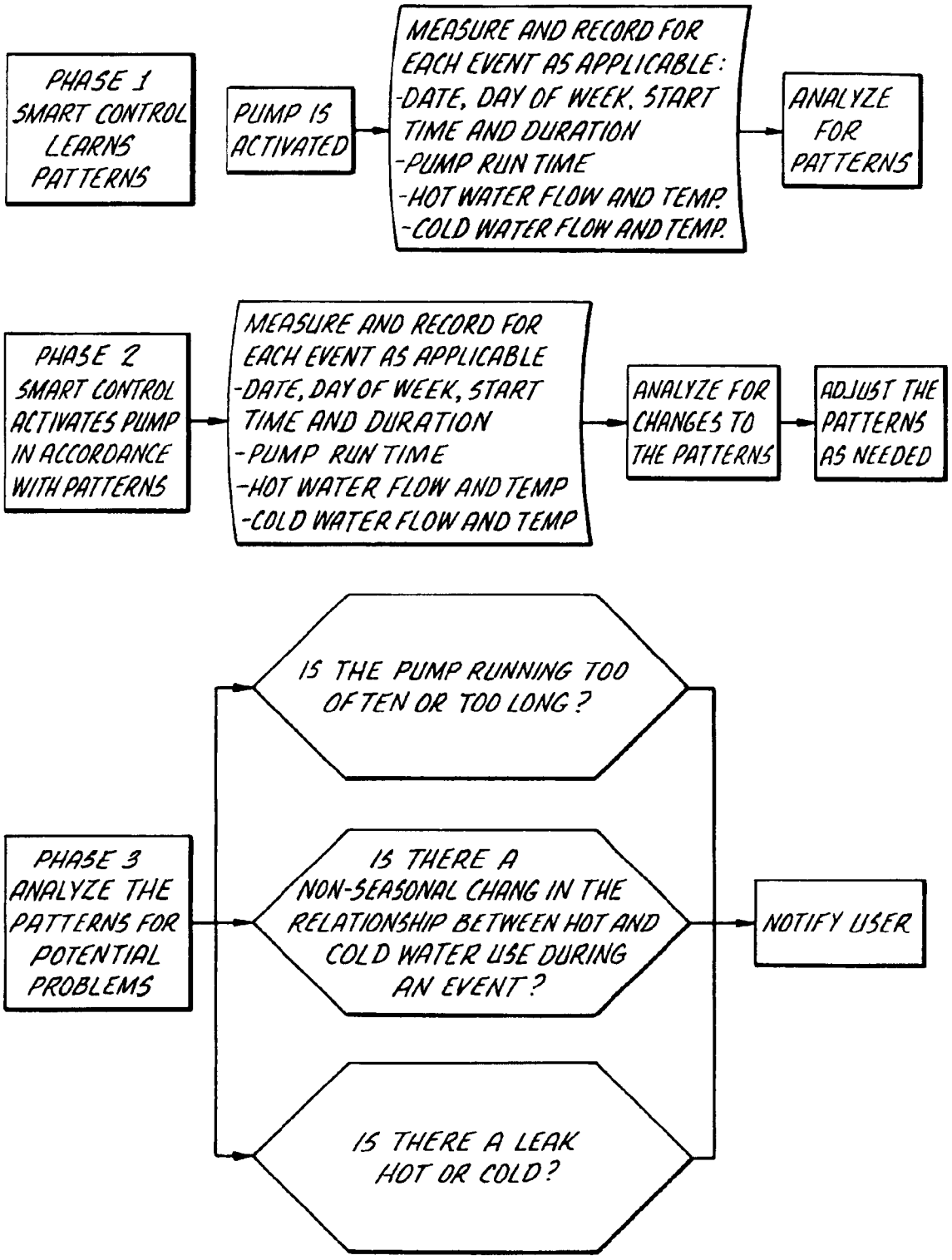
FIG. 3 is a block diagram of the method of operating a plumbing system in accordance with the present invention.

As illustrated in FIG. 3, a method in accordance with the present invention includes sensing activation of said pump 30, recording for each sensed activation at least one parameter selected from a group consisting of date, day of the week, start time, duration of pump activation, hot water flow and temperature and cold water flow and temperature; analyzing the recorded parameter to determine positions of pump activation; and activating the pump in accordance with the determined patterns.

Preferably, the method further includes reiterating the steps of sensing, recording, analyzing, and activating.

In addition, the method may include analyzing the determined patterns for potential problems and reporting therein. Such problems may include leaks, excessive running of the pump 30, and non-seasonal changes in a selection between hot water and cold water use among others.

Figure 4:
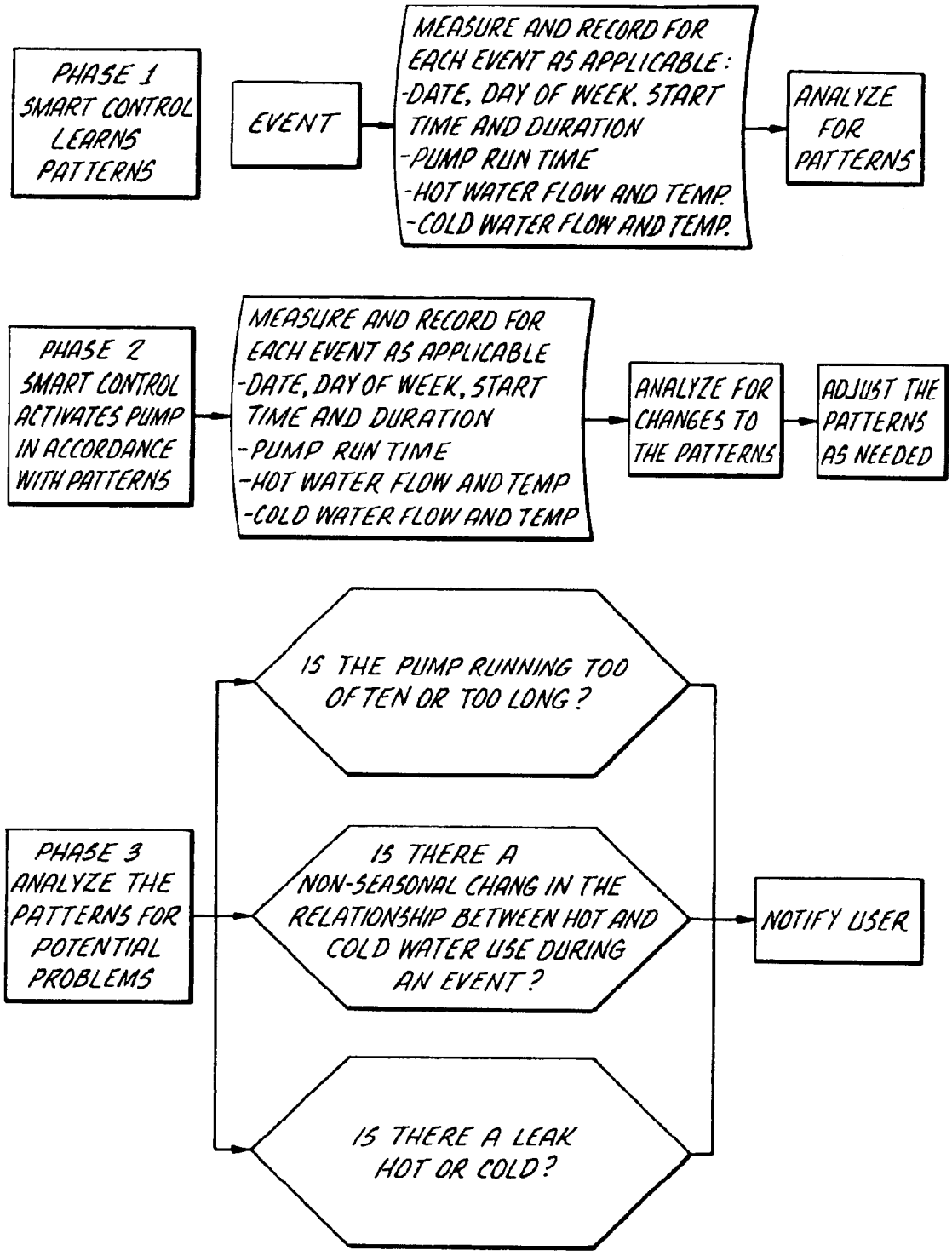
FIG. 4 is a block diagram of the method of operating a multi-family or commercial plumbing system in accordance with the present invention.

As illustrated in FIG. 4, a method for operating a multi-family or commercial plumbing system in accordance with the present invention includes sensing an event and recording for each sensed event at least parameter selected from a group consisting of date, day of the week, start time, duration of the event, water flow, water temperature and humidity.

Thereafter, the recorded parameters are analyzed to determine patterns and water flow circulation, water temperature, water use are controlled in accordance with the determined patterns.

The events sensed in accordance with the present invention may include, but are not limited, measurement of water temperature and water flow between a storage tank and a boiler, measurement of water flow in and out of the boiler, detection of water leaks and hot and cold water lines, measurement of water temperature and hot water flow from hot water heater, measurement of moisture in walls and floors, detection of activation of dampers, measurement of room temperature in each of plurality of rooms, detection of operation of water circulation pump.

All of this structure, or portions thereof, are commonly found in multi-family homes, apartments, condo complexes, hotels and other commercial properties. Specific illustration of each of these known structures is not included here for the sake of clarity.

As in the hereinabove described methods of the present invention, the plumbing security method in accordance with the present invention further includes reiterating the steps of sensing, recording, analyzing, and controlling on a continuous or repetitive basis.

Although there has been hereinabove described a specific method for operating a multi family/commercial plumbing system in accordance with the present invention for the purpose of illustrating the manner in which the invention may be used to advantage, it should be appreciated that the invention is not limited thereto. That is, the present invention may suitably comprise, consist of, or consist essentially of the recited elements. Further, the invention illustratively disclosed herein suitably may be practiced in the absence of any element which is not specifically disclosed herein. Accordingly, any and all modifications, variations or equivalent arrangements which may occur to those skilled in the art, should be considered to be within the scope of the present invention as defined in the appended claims.

What is claimed is:

1. Method for operating a multi family/commercial plumbing system, the method comprising:

sensing an event, said event comprising at least one of a group consisting of measurement of water flow in and out of a boiler; detection of water leaking in hot and cold water lines; measurement of moisture in walls and floors; detection of activation of dampers; measurement of room temperature in each of a plurality of rooms; detection of operation of a water circulating pump;

recording for each sensed events at least one parameter selected from a group consisting of date, day of the week, start time, duration of the event, water flow, with temperature and humidity;

analyzing the recording of each sensed event to determine patterns; and controlling water flow, circulation, water temperature, and water use in accordance with the determined pattern.

2. The method according to claim 1 further comprises reiterating the steps of sensing, recording, analyzing, and activating.

3. The method according to claim 1 further comprising analyzing the determined patterns for potential problems and reporting therein.

4. The method according to claim 3 wherein the potential problem is excessive running of a pump.

5. The method according to claim 3 wherein the potential problem is a non-seasonal change in a relationship between hot and cold water use.

6. The method according to claim 2 further comprising analyzing the determined patterns for potential problems and reporting therein.

7. The method according to claim 6 wherein the potential problem is excessive running of a pump.

8. The method according to claim 7 wherein the potential problem is a non-seasonal change in a relationship between hot and cold water use.

* * * * *

UNITED STATES PATENT AND TRADEMARK OFFICE

CERTIFICATE OF CORRECTION

PATENT NO. : 6,962,162 B2
APPLICATION NO. : 10/936173
DATED : November 8, 2005
INVENTOR(S) : Ackers et al.

It is certified that error appears in the above-identified patent and that said Letters Patent is hereby corrected as shown below:

In the Claims

Column 8

Claim 1, lines 36-39, should read --recording for each sensed event ~~[[s]]~~ at least one parameter selected from a group consisting of date, day of the week, start time, duration of the event, water flow, [[with]] ~~water~~ temperature and humidity;--

Signed and Sealed this
Seventh Day of May, 2013

Teresa Stanek Rea
*Acting Director of the United States Patent and Trademark Office*

UNITED STATES PATENT AND TRADEMARK OFFICE

CERTIFICATE OF CORRECTION

PATENT NO. : 6,962,162 B2
APPLICATION NO. : 10/936173
DATED : November 8, 2005
INVENTOR(S) : Ackers et al.

It is certified that error appears in the above-identified patent and that said Letters Patent is hereby corrected as shown below:

In the Claims

Column 8

Claim 1, lines 36-39, should read --recording for each sensed event at least one parameter selected from a group consisting of date, day of the week, start time, duration of the event, water flow, water temperature and humidity;--

This certificate supersedes the Certificate of Correction issued May 7, 2013.

Signed and Sealed this
Fifteenth Day of October, 2013

Teresa Stanek Rea
*Deputy Director of the United States Patent and Trademark Office*